US008129013B2

(12) United States Patent
Ichigaya

(10) Patent No.: US 8,129,013 B2
(45) Date of Patent: Mar. 6, 2012

(54) HUMAN-BODY AIMED SPACER, HUMAN-BODY AIMED AIRFLOW PASSAGE, AND GENERAL-PURPOSE SPACER

(75) Inventor: Hiroshi Ichigaya, Saitama (JP)

(73) Assignee: Seft Development Laboratory Co., Ltd., Saitama-shi (JP)

( * ) Notice: Subject to any disclaimer, the term of this patent is extended or adjusted under 35 U.S.C. 154(b) by 753 days.

(21) Appl. No.: 12/279,156

(22) PCT Filed: Feb. 8, 2007

(86) PCT No.: PCT/JP2007/000071

§ 371 (c)(1), (2), (4) Date: Nov. 21, 2008

(87) PCT Pub. No.: WO2007/094130

PCT Pub. Date: Aug. 23, 2007

(65) Prior Publication Data

US 2009/0208693 A1 Aug. 20, 2009

(30) Foreign Application Priority Data

Feb. 13, 2006 (JP) ..... 2006-034995
May 2, 2006 (JP) ..... 2006-128382
Dec. 6, 2006 (JP) ..... 2006-329287

(51) Int. Cl.
*B32B 3/12* (2006.01)
*B32B 3/30* (2006.01)

(52) U.S. Cl. ..... 428/76; 428/178; 428/180

(58) Field of Classification Search ..... 428/76, 428/178, 179, 180; 5/423; 52/660, 663, 52/793.1
See application file for complete search history.

(56) References Cited

U.S. PATENT DOCUMENTS

2004/0083526 A1* 5/2004 Ichigaya ..... 2/2.14

* cited by examiner

*Primary Examiner* — Alexander Thomas
(74) *Attorney, Agent, or Firm* — Crowell & Moring LLP

(57) ABSTRACT

There is provided a human-body aimed spacer for restricting rugged feeling, which is flexible and light-weighted and requires only a smaller storage space. The spacer comprises a number of convex parts 20, and flexible connecting portions 26. The convex parts 20 each comprises: a frame-like portion 21 formed at a side contacting with a human body; four column portions 22, each having one end continuing to the frame-like portion, and each being formed to rise from the frame-like portion; and a rising-portion integrator 23 for interconnecting the other ends of the column portions 22 with one another. The flexible connecting portions 26 each interconnect adjacent ones of the frame-like portions 21 with each other. The spacer is configured to contact with a human body at the side where the frame-like portions 21 are formed, and to abut on a cushion or the like at the side where the rising-portion integrators are formed.

17 Claims, 11 Drawing Sheets

HUMAN-BODY AIMED SPACER, HUMAN-BODY AIMED AIRFLOW PASSAGE, AND GENERAL-PURPOSE SPACER

TECHNICAL FIELD

The present invention relates to: a human-body aimed spacer to be exemplarily used for air-conditioning mats, air-conditioning seat cushions, air-conditioning chairs, air-conditioning clothes, air-conditioning beds and the like for cooling a human body; a human-body aimed airflow passage adopting such a human-body aimed spacer; and a general-purpose spacer to be used for various usages.

BACKGROUND ART

There have been conventionally proposed: various cooling spacers to be exemplarily used for air-conditioning mats, air-conditioning seat cushions, air-conditioning chairs, air-conditioning clothes, air-conditioning beds and the like; and human-body aimed airflow passages adopting such cooling spacers. For example, also the present inventor has proposed a cooling spacer, and a cooling airflow passage utilizing the spacer, as described in a patent literature 1. As exemplarily described in the patent literature 1, most of the conventional cooling spacers each include protrusions formed on a flat plate-like base member.

Patent Literature 1: WO2001/024664A1

DISCLOSURE OF THE INVENTION

Technical Problem

Incidentally, when applicable one of the above-mentioned conventional cooling spacers is used for a cooling device (which may also be called "air-conditioning mat" hereinafter) to be used by deploying the device onto a chair, bed, or the like, and when a user has sat on the air-conditioning mat or lain down thereon through the cooling spacer, tip ends of numerous protrusions of the cooling spacer are brought to abut against the body of the user, thereby possibly imposing rugged feeling to the user. As such, conventional cooling spacers have been each provided with an additional mesh-like member over tip ends of protrusions, so as to restrict such a rugged feeling. This results in a problem that air-conditioning mats and the like adopting the conventional cooling spacers are complicated in structure, thereby complicating manufacturing processes thereof, with increased costs.

Further, conventional cooling spacers each include protrusions formed on a flat plate-like base member which is insufficient in elasticity, so that the spacers are not allowed to be folded, for example. This has caused such a problem that applicable cooling spacers require larger spaces upon storing or transporting them, in case of those for larger items such as air-conditioning mats to be used by deploying them on beds.

Moreover, a base member formed in a flat plate shapes of each conventional cooling spacer is insufficient in elasticity, such that even when various air-conditioning mats adopting the conventional spacers are used by placing them on soft mattresses, cushions, or the like, the spacers deteriorate the due functions of the mattresses or cushions, thereby exhibiting a problem that users are unable to feel elasticities of the mattresses, cushions, or the like.

Furthermore, conventional cooling spacers are heavy in weight, so that larger spacers such as for air-conditioning mats to be used by deploying them onto beds bring about a problem of difficulty in handling of the spacers upon exemplarily transporting and/or storing them.

Further, without limited to spacers for human bodies, spacers for ensuring spaces for allowing airflow therethrough, such as conventional spacers to be used for pet-aimed sheets, spacers for closets, and the like, include flat plate-like base members having protrusions formed thereon such that the base members formed in flat plate shapes are insufficient in elasticity, so that the spacers are not allowed to be folded. Moreover, such conventional spacers are heavy in weight, thereby bringing about a problem of difficulty in handling of the spacers upon exemplarily transporting and/or storing them.

The present invention has been carried out in view of the above circumstances, and it is therefore an object of the present invention to provide a human-body aimed spacer and a human-body aimed airflow passage each capable of restricting a rugged feeling, exhibiting a smaller storage space, achieving an improved elasticity and being lightened in weight.

Further, the present invention has also been carried out in view of the above circumstances, and it is therefore another object of the present invention to provide a general-purpose spacer capable of exhibiting a smaller storage space, achieving an improved elasticity and being lightened in weight.

Solution to Problem

To achieve the above object, the invention resides in a human-body aimed spacer for ensuring a space near a human body for allowing air to flow therethrough, comprising:

convex parts each comprising: a frame-like portion; a rising portion comprising column portions, or wall portions, or column portions and wall portions, each of them having one end formed to rise from the associated frame-like portion; and a rising-portion integrator for interconnecting the other ends of the associated rising portion with one another; and flexible connecting portions having flexibility and interconnecting the convex parts with each other;

wherein the convex parts are formed in a number of at least 100 per 1 $m^2$; and wherein the convex parts and the flexible connecting portions are formed of plastic integrally with one another.

Further, to achieve the above object, the invention resides in a human-body aimed airflow passage comprising:

the human-body aimed spacer of; and a sack-shaped sheet part insusceptible to air leakage and configured to cover the human-body aimed spacer, the sack-shaped sheet part comprising a sheet at a side contacting with a human body, and the sack-shaped sheet part having a moisture permeability at least through the sheet;

wherein the sack-shaped sheet part is formed with: an air inlet part for allowing air inflow therethrough; and an air outlet part for discharging air therethrough.

Moreover, to achieve the above object, the invention resides in a general-purpose spacer comprising:

a plurality of convex parts each comprising: a frame-like portion; a rising portion comprising column portions, or wall portions, or column portions and wall portions, each of them having one end formed to rise from the associated frame-like portion; and a rising-portion integrator for interconnecting the other ends of the associated rising portion with one another; and flexible connecting portions for interconnecting adjacent ones of the frame-like portions with each other in a longitudinal direction and a lateral direction of the general-purpose spacer, the flexible connecting portions each having flexibility capable of being bent by about 180 degrees while keeping the associated convex parts outside;

wherein, assuming that a pitch between centers of adjacent two of the convex parts is P millimeters, the general-purpose spacer is so formed that: P is 5 to 200; the general-purpose spacer has a density p of (10/P+0.2) % to (120/P+10) %, relative to a volume of space defined by the general-purpose spacer; and the height "h" of the general-purpose spacer is (3 to P) millimeters.

Advantageous Effects of Invention

According to the human-body aimed spacer according to the invention, the frame-like portions, or the rising-portion integrators having substantially the same sizes as the frame-like portions, respectively, are brought to abut on a body of a user, thereby avoiding imposition of rugged feeling to the user, unlike conventional cooling spacers including tip ends of protrusions to be brought to abut against bodies of users. Further, the adjacent convex parts are interconnected by the associated flexible connecting portion with each other to thereby form the numerous convex parts integrally with one another in the human-body aimed spacer of the present invention, thereby allowing for improvement of elasticity of the human-body aimed spacer as compared with conventional cooling spacers each configured to interconnect protrusions by a base member. Furthermore, the adjacent convex parts are interconnected by the associated flexible connecting portion with each other to thereby form the numerous convex parts integrally with one another in the human-body aimed spacer of the present invention, so that the human-body aimed spacer can be easily wound spirally and then stored in a storage space smaller than those for conventional cooling spacers. Moreover, since the adjacent convex parts are interconnected by the associated flexible connecting portion with each other to thereby form the numerous convex parts integrally with one another in the human-body aimed spacer of the present invention, it becomes possible to decrease an amount of material to be used and thus to lighten the human-body aimed spacer of the present invention in weight, as compared with conventional cooling spacers each including a flat plate-like base member. Additionally, the human-body aimed spacer of the present invention allows a space to be ensured for flowing air therethrough near a human body, so that water vapor resulted from evaporation of perspiration from the human body is discharged to the exterior through the space. Thus, the human-body aimed spacer of the present invention is capable of promoting evaporation of perspiration from the human body.

According to the human-body aimed airflow passage according to the invention, the upper sheet of the sheet part for covering that side of the spacer at the frame-like portions or at the rising-portion integrators in substantially the same sizes as the frame-like portions, respectively, is brought to contact with a body of a user, thereby avoiding imposition of rugged feeling to the user, unlike conventional airflow passages including tip ends of protrusions to be brought to abut against bodies of users. Further, the adjacent convex parts are interconnected by the associated flexible connecting portion with each other to thereby form the numerous convex parts integrally with one another in the human-body aimed airflow passage of the present invention, thereby allowing for improvement of elasticity of the human-body aimed airflow passage as compared with conventional airflow passages adopting spacers each configured to interconnect protrusions by a base member. Furthermore, the adjacent convex parts are interconnected by the associated flexible connecting portion with each other to thereby form the numerous convex parts integrally with one another in the human-body aimed airflow passage of the present invention, so that the human-body aimed airflow passage can be easily wound spirally and then stored in a manner that the convex parts are hidden inside, in a storage space smaller than those for conventional ones. Moreover, since the adjacent convex parts are interconnected by the associated flexible connecting portion with each other, it becomes possible to decrease an amount of material to be used and thus to lighten the human-body aimed airflow passage of the present invention in weight, as compared with conventional ones each adopting a spacer having a flat plate-like base member. Additionally, the human-body aimed airflow passage of the present invention allows a space to be ensured for flowing air therethrough near a human body, and the sheet part has a moisture permeability at least through a sheet at the side contacting with the human body, thereby enabling to promote evaporation of perspiration from the human body through the space and the sheet, and to discharge water vapor caused by evaporation of perspiration to the exterior through the space and the sheet.

According to the general-purpose spacer according to the invention, the adjacent frame-like portions are interconnected by the associated flexible connecting portion with each other to thereby form the numerous convex parts integrally with one another, thereby allowing for improvement of elasticity of the general-purpose spacer as compared with conventional spacers each configured to interconnect protrusions by a base member. Further, the adjacent frame-like portions are interconnected by the associated flexible connecting portion with each other to thereby form the numerous convex parts integrally with one another in the general-purpose spacer of the present invention, so that the general-purpose spacer can be easily wound spirally and then stored in a storage space smaller than those for conventional spacers. Furthermore, since the adjacent frame-like portions are interconnected by the associated flexible connecting portion with each other to thereby form the numerous convex parts integrally with one another in the general-purpose spacer of the present invention, it becomes possible to decrease an amount of material to be used and thus to lighten the general-purpose spacer of the present invention in weight, as compared with conventional cooling spacers each including a flat plate-like base member. Moreover, according to the general-purpose spacer of the present invention, the frame-like portions, or the rising-portion integrators in substantially the same sizes as the frame-like portions, respectively, are brought to abut on a body of a pet upon adoption of the spacer for a pet-aimed sheet, for example, thereby avoiding imposition of rugged feeling to the body of the pet, unlike conventional cooling spacers including tip ends of protrusions to be brought to abut against bodies of pets.

REFERENCE SIGNS OF LIST

Figure 1A:
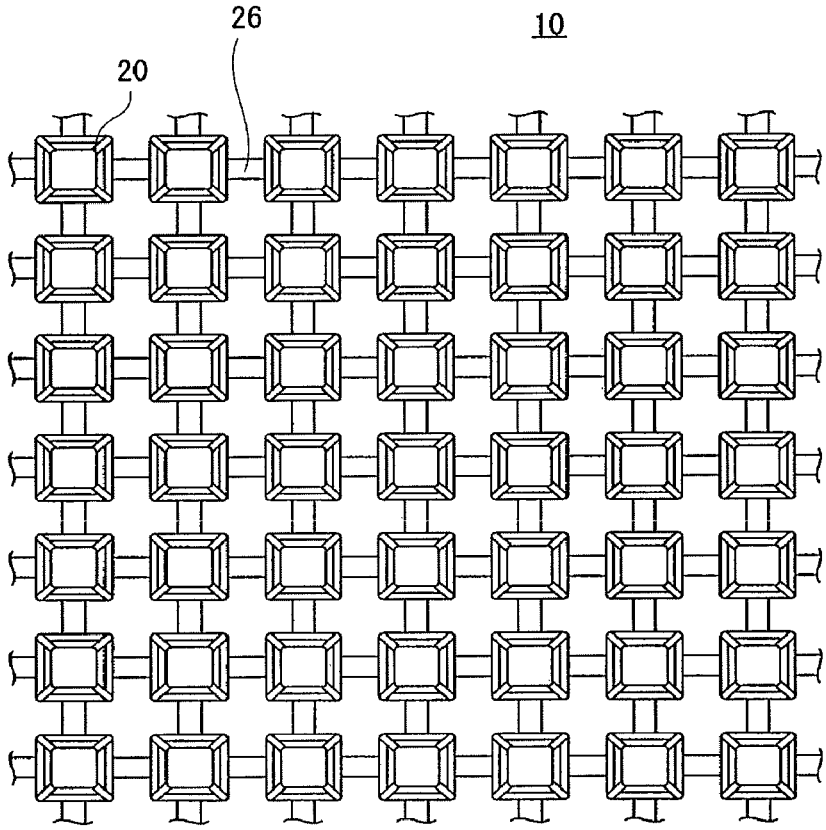
FIG. 1(*a*) is a schematic partial front view of a human-body aimed spacer according to a first embodiment of the present invention, and FIG. 1(*b*) is a schematic partial side view of the human-body aimed spacer.

10, 10*a*, 10*b*, 10*c*, 10*d*, 10*e* spacer
20, 20*a*, 20*b*, 20*c*, 20*d*, 20*e* convex part
21, 21*b*, 21*e*, 21*c* frame-like portion
22, 22*d* column portion
23, 23*a*, 23*b*, 23*c*, 23*d*, 23*e* rising-portion integrator
24, 24*c*, 24*e* wall portion
26, 26*e* flexible connecting portion
100 air-conditioning mat
110 airflow passage
111 sack-shaped sheet part
112 air inlet part
111*a* upper sheet
111*b* lower sheet
120 connecting passage
130 fan
140 power supply transformer
150 switch
500 pet-aimed sheet
510 sack-shaped sheet part

BEST MODE(S) FOR CARRYING OUT THE INVENTION

First Embodiment

Figure 1B:
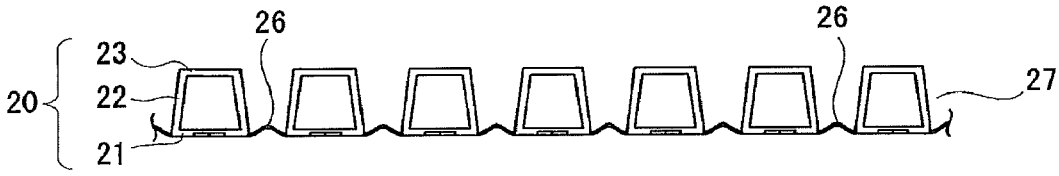

There will be described hereinafter the best mode for carrying out the present invention, with reference to the accompanying drawings. FIG. 1(*a*) is a schematic front view of a human-body aimed spacer according to a first embodiment of the present invention, FIG. 1(*b*) is a schematic side view of the human-body aimed spacer, FIG. 2(*a*) is a schematic perspective view of a convex part of the human-body aimed spacer according to the first embodiment of the present invention, and FIG. 2(*b*) is a schematic partial perspective view of the human-body aimed spacer shown in FIG. 1.

This embodiment resides in a human-body aimed spacer 10 comprising: a large number of convex parts 20 having frame-like portions 21, respectively; and flexible connecting portions 26 for interconnecting adjacent ones of the frame-like portions 21 with each other.

The convex parts 20 of this embodiment each include: an associated frame-like portion 21; four column portions 22 acting as a rising portion, each column portion having one end continuing to the frame-like portion 21, and each column portion formed to rise from the frame-like portion 21; and a rising-portion integrator 23 for interconnecting the other ends of the four column portions 22 with one another. The human-body aimed spacer 10 of this embodiment exemplarily has one side formed with the frame-like portions 21 and acting as a side to abut on a human body, and the other side formed with the rising-portion integrators 23 and acting as another side to abut on a cushion or the like. The frame-like portions 21 are each formed in a substantially square shape, which square has four corners formed with the column portions 22, respectively, and four sides each formed with a flexible connecting portion 26 in the middle thereof.

The flexible connecting portions 26 of this embodiment are provided to interconnect adjacent convex parts 20 through frame-like portions 21 thereof, respectively, and are each formed of a strip-shaped member having a thickness smaller than that of each frame-like portion 21. In this way, the flexible connecting portions 26 formed to have smaller thicknesses are allowed to have flexibility. Further, in this embodiment, the flexible connecting portions 26 are formed to be bent to protrude toward a side of rising-portion integrators 23. The protruded extent of each flexible connecting portion is desirably configured to cause at least about 5% of difference between the length of the flexible connecting portion 26 when straightly stretched and the length of the flexible connecting portion 26 when naturally bent. This is to further improve the elasticity of the human-body aimed spacer 10 as a whole. Note that the flexible connecting portions of the human-body aimed spacer of the present invention are not necessarily required to interconnect the adjacent frame-like portions with each other, and may interconnect the adjacent rising portions or rising-portion integrators with each other, insofar as configured to interconnect the adjacent convex parts with each other.

Upon usage of the human-body aimed spacer for an air-conditioning mat to be exemplarily deployed on a chair, bedclothes, or the like, the human-body aimed spacer is required to be formed to avoid collapse of the convex parts 20 due to application of a weight of a human body, so as to ensure a human-body aimed airflow passage (which may also be simply called "airflow passage" hereinafter). In case of the human-body aimed spacer 10 of this embodiment, the convex parts 20 are configured to cooperatively possess a strength insusceptible to collapse even by application of a weight of a human body, while the flexible connecting portions 26 are previously bent by making them of thin strip-shaped members so that the flexible connecting portions 26 are easily deformed. The convex parts 20 interconnected by such flexible connecting portions 26 with one another in this embodiment, are each capable of being displaced in a substantially independent manner, thereby causing the human-body aimed spacer 10 to be sufficient in elasticity as a whole.

For example, when the human-body aimed spacer of this embodiment is used for an air-conditioning mat or the like to be used by deploying it onto a bed, the flexible connecting portions 26 of this embodiment are each desirably formed to be capable of bending by about 180 degrees in a direction that two frame-like portions 21 associated with each flexible connecting portion 26 confront with or abut against each other, without deformation of the convex parts 20. This allows for deformation of the human-body aimed spacer along a contour of a body of a user lying on the mat by virtue of the flexible connecting portions 26, thereby enabling to easily ensure a required space without collapse of the convex parts.

Even when the air-conditioning mat adopting the human-body aimed spacer 10 of this embodiment is placed on a cushion, the air-conditioning mat is allowed to cool a body of a user while ensuring due airflow passage without considerably deteriorating the function of the cushion itself. Namely, according to a cooling device such as an air-conditioning mat adopting the human-body aimed spacer 10 of this embodiment, the user is allowed to satisfactorily feel not only coolness but also softness of a cushion to be used. Note that the human-body aimed spacer of this embodiment is capable of not only cooling a human body, but also warming the human body by flowing warm air through the airflow passage. Further, it is enough for the human-body aimed spacer of this embodiment to simply ensure a airflow passage under a human body, without flowing ambient air, warm air, or the like through the airflow passage by means of fans or the like. Even in such a situation, it is possible to promote evaporation of perspiration from a human body by virtue of the airflow passage, and to cause water vapor due to evaporation of perspiration to be outwardly discharged through the airflow passage. Further, the human-body aimed spacer 10 of this embodiment comprises the flexible connecting portions 26 susceptible to deformation, so that the human-body aimed spacer 10 is allowed to be easily wound spirally and then stored in a manner that the convex parts are hidden inside. It is also possible for the human-body aimed spacer 10 of this embodiment to be stored in a two-fold or four-fold manner.

Further, the frame-like portions and flexible connecting portions are formed in such sizes that those regions (which may also be simply called "opening regions" hereinafter) where no frame-like portions and no flexible connecting portions are formed, allow water vapor to easily permeate therethrough. Namely, the frame-like portions and flexible connecting portions are so formed that a ratio of area of opening regions is 50 to 95% of a whole area of the spacer face at the side where the frame-like portions are formed. The ratio of area of the opening regions larger than 95% leads to difficulty in formation of the spacer, and the ratio smaller than 50% leads to excessively larger contact area between a human body and the spacer, thereby causing a problem that vaporizedly caused water vapor is insusceptible to permeation into space ensured by the spacer.

Moreover, in this human-body aimed spacer, each frame-like portion is of longitudinal length of about 10 mm×lateral length of about 10 mm×width of about 1 mm×thickness of about 1.5 mm; each convex part has a height of about 10 mm; each rising-portion integrator is of longitudinal length of about 8 mm×lateral length of about 8 mm×thickness of about 1.5 mm; each column portion has a diameter of about 1.5 mm; and each flexible connecting portion is of length of about 5 mm×width of about 3 mm×thickness of about 1 mm. Note that the human-body aimed spacer of the present invention is not limited to the above, and the convex parts and associated frame-like portions of this human-body aimed spacer may be provided in any sizes insofar as the convex parts or frame-like portions are formed in a number of at least about 400 per 1 $m^2$. In case of the number less than it: convex parts are excessively increased in size, and thus the human-body aimed spacer is insufficient in elasticity; or if the convex parts are provided in substantially the same size as this embodiment, a spacing among adjacent convex parts is excessively increased to rather problematically lead to difficulty in ensuring space for flowing air therethrough. In turn, the human-body aimed spacer of the present invention can be specified in the following manner. For example, the human-body aimed spacer of the present invention is to desirably have a density of 30% or less relative to a volume of space defined by the spacer. The human-body aimed spacer of this embodiment constituted in the above manner, enables a less amount of material to be used which is 1 kg or less per 1 $m^2$, as compared with conventional spacers each including a flat plate-like base member formed with protrusions.

Further, the human-body aimed spacer desirably has a height of about 3 mm to 50 mm. The height lower than 3 mm leads to a narrower airflow passage and thus a larger load to a fan part, while the height larger than 50 mm merely leads to a larger spacer with unchanged effects of the spacer.

The human-body aimed spacer 10 of this embodiment can be formed by injection molding, i.e., by injecting a molten resin such as polyethylene, polypropylene, or the like into a mold, followed by cooling and solidification.

Figure 2A:
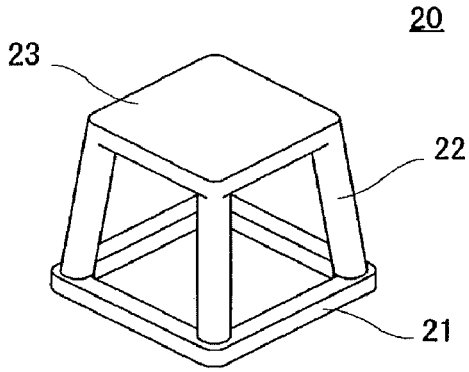
FIG. 2(*a*) is a schematic perspective view of one convex part of the human-body aimed spacer according to the first embodiment of the present invention, and FIG. 2(*b*) is a schematic partial perspective view of the human-body aimed spacer.
Figure 2B:
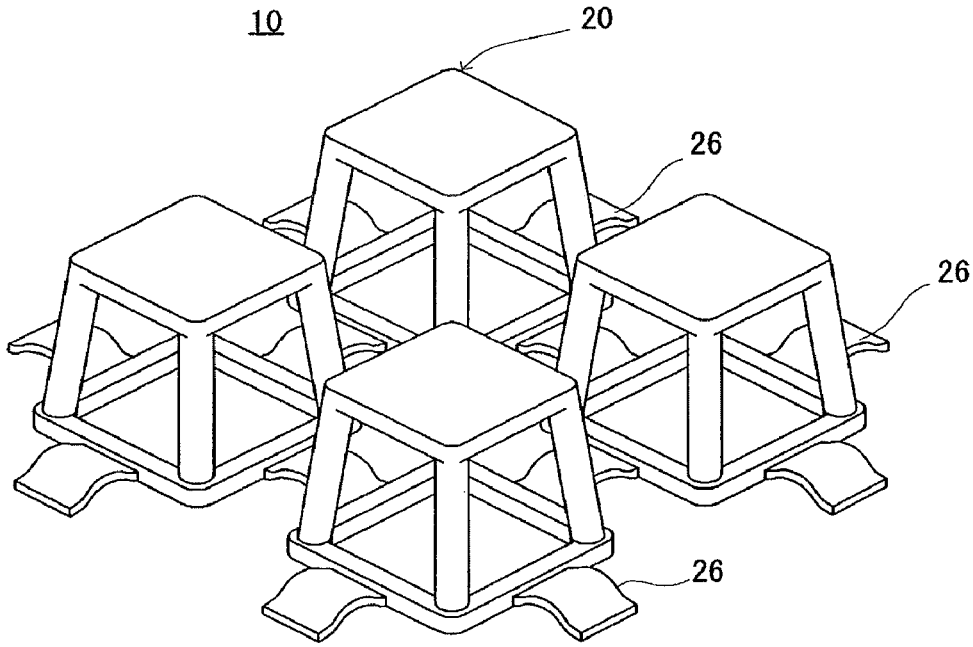
Figure 3A:
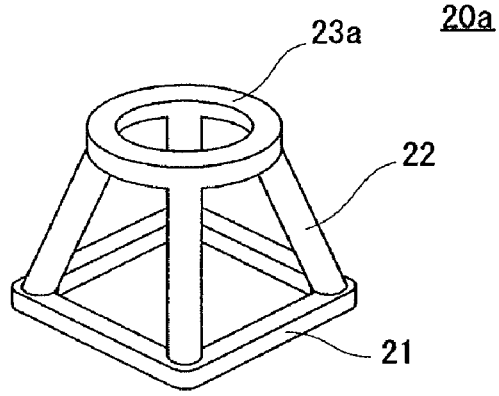
FIG. 3 is a figure showing a variant of a rising-portion integrator of the first embodiment, FIG. 3(*a*) is a schematic perspective view of one convex part of a spacer according to the variant, and FIG. 3(*b*) is a schematic partial perspective view of the spacer according to the variant in a manner corresponding to FIG. 2(*b*) for the first embodiment.
Figure 3B:
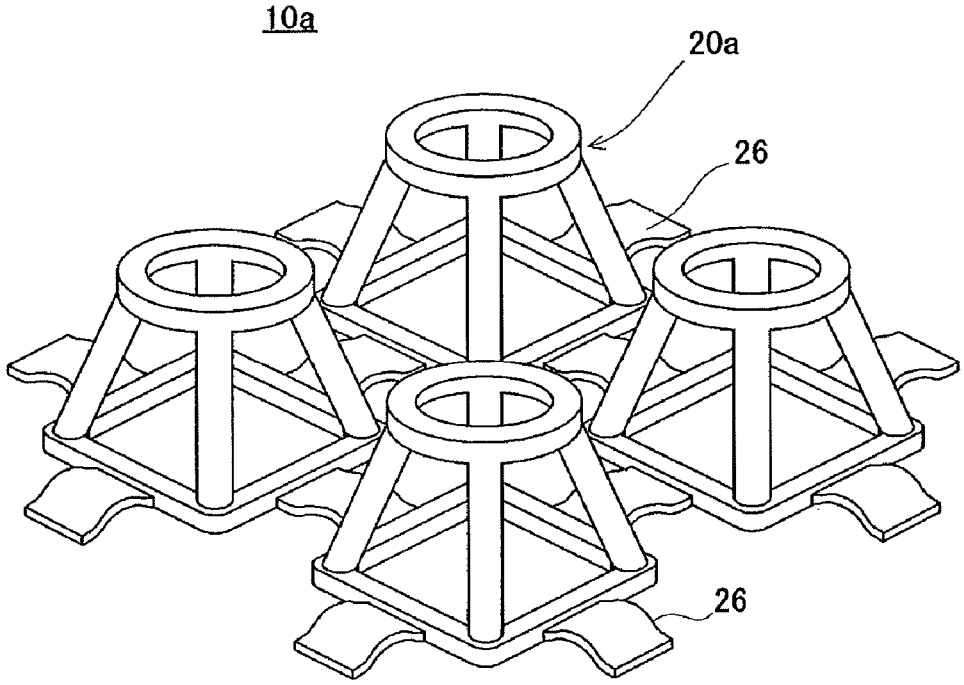

FIG. 3 is a figure showing a variant of a rising-portion integrator of the first embodiment, FIG. 3(*a*) is a schematic perspective view of a convex part of a human-body aimed spacer according to the variant, and FIG. 3(*b*) is a schematic partial perspective view of the human-body aimed spacer according to the variant in a manner corresponding to FIG. 2(*b*) for the first embodiment.

The human-body aimed spacer of this variant is different from the human-body aimed spacer of the first embodiment only in terms of rising-portion integrators 23*a*, and is the same as the first embodiment in terms of the other portions. Thus, those elements in this variant which have the same functions as those in the first embodiment shown in FIG. 1 and FIG. 2, are designated by the same reference signs or corresponding reference signs, and detailed explanation thereof will be omitted. As shown in FIG. 3, each rising-portion integrator 23*a* of the human-body aimed spacer 10*a* of this variant is formed in a ring shape. The other configurations are the same as those in the first embodiment. Further, the functions and effects of this variant are the same as those in the first embodiment.

Second Embodiment

Figure 4A:
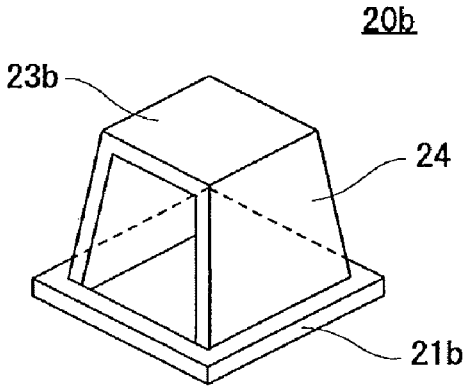
FIG. 4(*a*) is a schematic perspective view of one convex part of a spacer according to a second embodiment of the present invention, and FIG. 4(*b*) is a schematic partial perspective view of the spacer according to the second embodiment in a manner corresponding to FIG. 2(*b*) for the first embodiment.
Figure 4B:
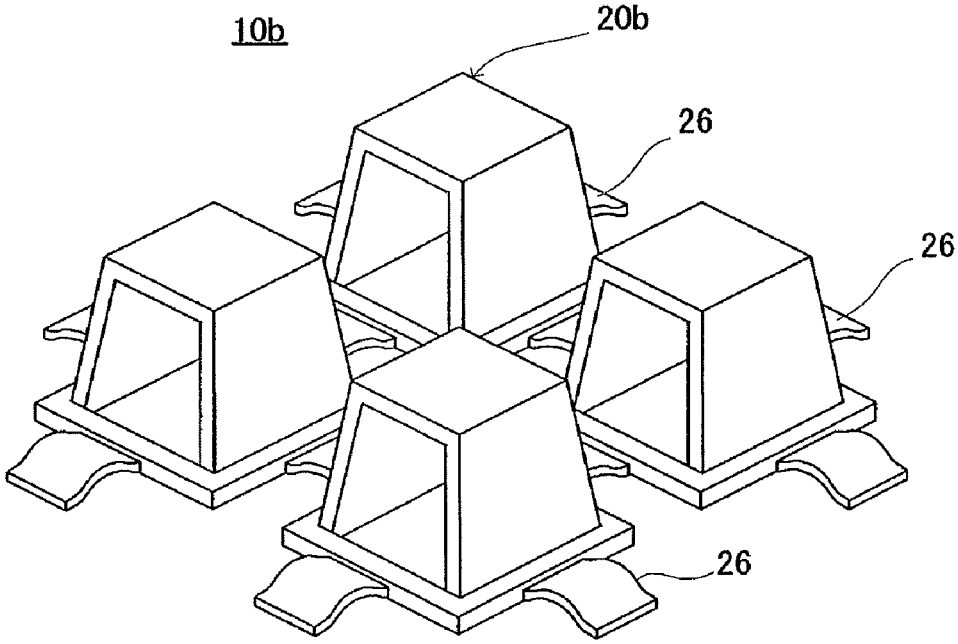

There will be explained a second embodiment of the present invention. FIG. 4(*a*) is a schematic perspective view of one convex part of a human-body aimed spacer according to the second embodiment of the present invention, and FIG. 4(*b*) is a schematic partial perspective view of the human-body aimed spacer according to the second embodiment in a manner corresponding to FIG. 2(*b*) for the first embodiment.

The human-body aimed spacer 10*b* of this embodiment is different from the human-body aimed spacer of the first embodiment only in that a rising portion of one convex part comprises two wall portions 24 instead of four column portions, and the other portions are the same as those in the first embodiment. Thus, those elements in this embodiment which have the same functions as those in the first embodiment shown in FIG. 1 and FIG. 2, are designated by the same reference signs or corresponding reference signs, and detailed explanation thereof will be omitted.

As shown in FIG. 4, the rising portion of one convex part of this embodiment is constituted of two wall portions 24 instead of four column portions. Thus, the convex parts of the human-body aimed spacer of this embodiment are insusceptible to collapse, and in case that the human-body aimed spacer is used to provide a human-body aimed airflow passage, the wall portions are to be formed parallelly to a direction of airflow, thereby enabling to decrease a resistance to air in the same manner as the first embodiment. The other functions and effects of this embodiment are the same as those in the first embodiment.

Third Embodiment

Figure 5A:
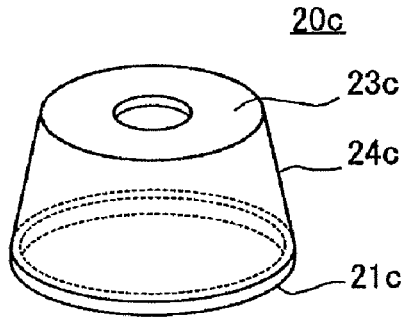
FIG. 5(*a*) is a schematic perspective view of one convex part of a human-body aimed spacer according to a third embodiment of the present invention, and FIG. 5(*b*) is a schematic partial perspective view of the human-body aimed spacer according to the third embodiment in a manner corresponding to FIG. 2(*b*) for the first embodiment.
Figure 5B:
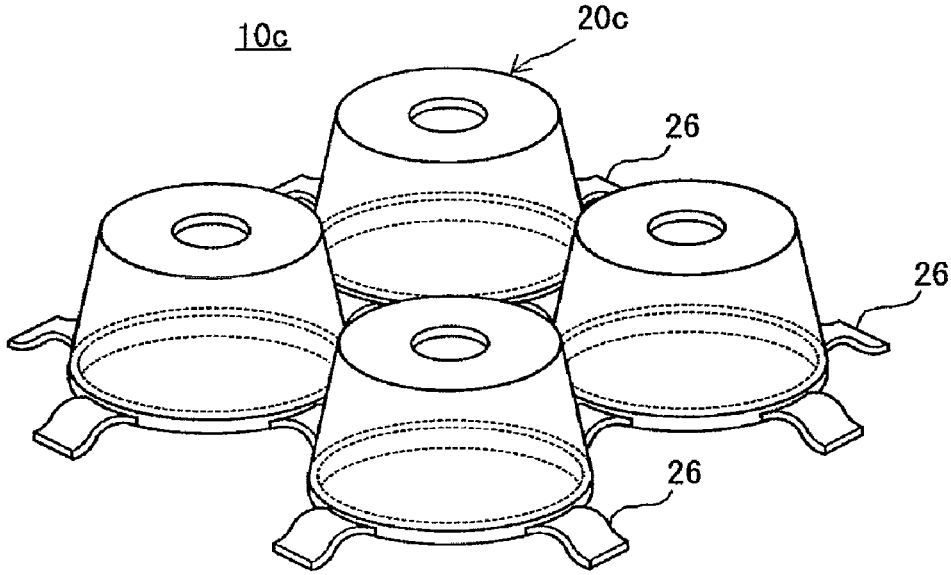

There will be explained a third embodiment of the present invention. FIG. 5(*a*) is a schematic perspective view of one convex part of a human-body aimed spacer according to the third embodiment of the present invention, and FIG. 5(*b*) is a schematic partial perspective view of the human-body aimed spacer according to the third embodiment in a manner corresponding to FIG. 2(*b*) for the first embodiment. The human-body aimed spacer of this embodiment comprises convex parts 20*c* each comprising: a frame-like portion 21*c* formed in a ring shape; a cylindrical wall portion 24*c* formed to rise from the frame-like portion 21*c* in the ring shape; and a rising-portion integrator 23*c* formed in a substantially donut shape having a circular opening region at the center. The other portions of this embodiment are the same as those in the first embodiment. Thus, those elements in this embodiment which have the same functions as those in the first embodiment shown in FIG. 1 and FIG. 2, are designated by the same reference signs or corresponding reference signs, and detailed explanation thereof will be omitted. In case of the convex part 20*c* of the human-body aimed spacer of this embodiment, the wall portion 24*c* for interconnecting the frame-like portion 21*c* and the rising-portion integrator 23*c* is formed in a substantially cylindrical shape as a whole, so that the convex part 20*c* of this embodiment is made more insusceptible to collapse. The other functions and effects of this embodiment are the same as those in the first embodiment.

Fourth Embodiment

Figure 6:
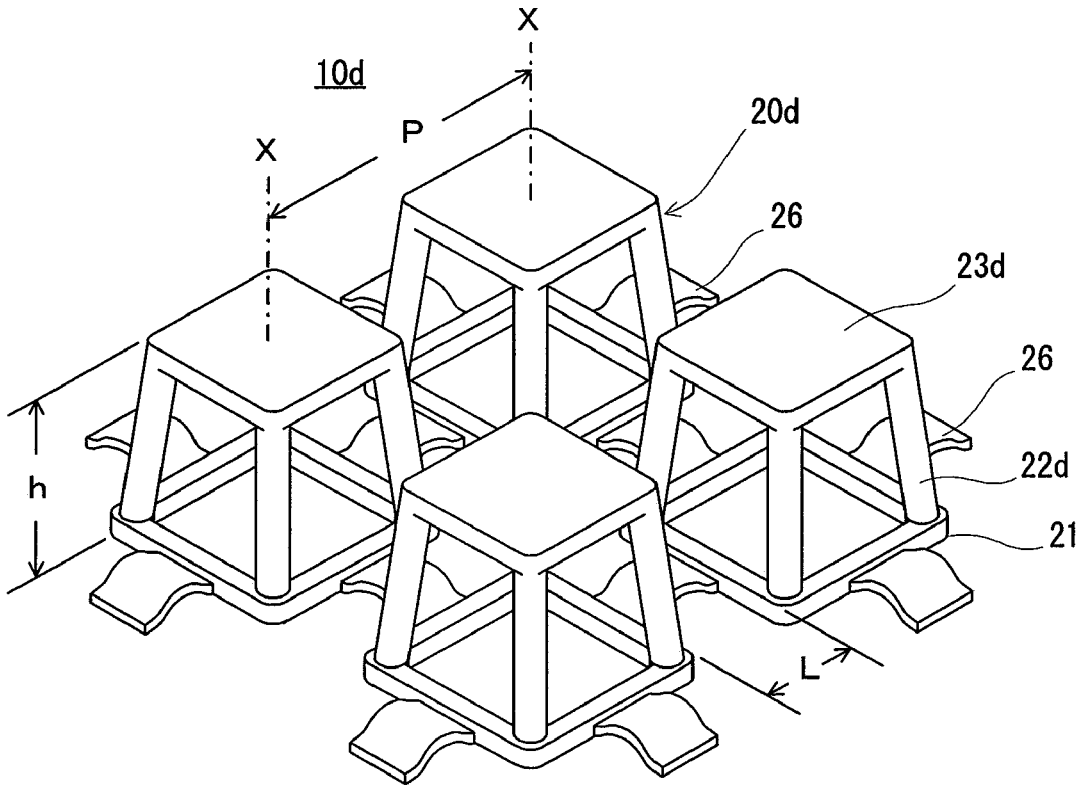
FIG. 6 is a schematic partial perspective view of a general-purpose spacer according to a fourth embodiment of the present invention in a manner corresponding to FIG. 2(*b*) for the first embodiment.

There will be explained a fourth embodiment of the present invention. FIG. 6(*a*) is a schematic partial perspective view of a general-purpose spacer according to the fourth embodiment of the present invention. Note that the shape of the general-purpose spacer of this embodiment is substantially the same as that of the human-body aimed spacer of the first embodiment, and the schematic perspective view of convex parts of this embodiment is omitted in depiction, since it is substantially the same as that of FIG. 2(*a*). Further, those elements in FIG. 6 which have the same functions as those in the human-body aimed spacer of the first embodiment, are designated by the same reference signs or corresponding reference signs, and detailed explanation thereof will be omitted.

In the general-purpose spacer 10*d* of this embodiment, a rising portion of one convex part comprises four column portions 22*d*, similarly to the human-body aimed spacer of the first embodiment. Further, the rising portion is formed in an inclined manner so that the rising portion approaches a central axis X of an associated convex part 20*d* as the rising portion approaches from an associated frame-like portion 21 toward an associated rising-portion integrator 23*d*.

Assuming that a pitch between centers of two adjacent convex parts is P millimeters, the general-purpose spacer 10*d* of this embodiment is desirably formed such that: P is 5 to 200; the spacer has a density ρ of (10/P+0.2)% to (120/P+10)%, relative to a volume of space defined by the spacer; the height "h" of the spacer is (3 to P) millimeters; and, each flexible connecting portion has a length L of P×(10% to 60%) millimeters. This is because, the density ρ less than (10/P+0.2)% leads to an excessively weaker strength of convex parts of the spacer, while the density ρ larger than (120/P+10)% leads to deteriorated air permeability of the spacer and to an increased weight thereof. Further, the pitch P less than 5 millimeters or the pitch P larger than 200 millimeters leads to difficulty in formation of the spacer by injection molding. In turn, the height "h" of the general-purpose spacer less than 3 millimeters leads to excessively narrow space to be ensured by the spacer, thereby leading to difficulty in exhibiting inherent effects as the spacer. Moreover, the height "h" of the general-purpose spacer larger than P millimeters leads to the excessively large height "h" relative to the pitch P, in a manner that the convex parts are susceptible to deformation, thereby leading to difficulty in keeping inherent functions as the spacer to ensure due space. Furthermore, the length L of the flexible connecting portion shorter than P×10% leads to difficulty in bending the flexible connecting portion by about 180 degrees, while the length L longer than P×60% leads to an excessively larger spacing among adjacent convex parts, thereby leading to difficulty in ensuring space by the spacer. The general-purpose spacer of this embodiment is to exemplarily have a pitch P of 16.5 mm, a density ρ=6%, a spacer height "h"=10 mm, and a length L=6 mm of each flexible connecting portion. The general-purpose spacer of this embodiment can be integrally formed of plastic such as polyethylene, polypropylene, or the like, by injection molding.

In case of the general-purpose spacer of this embodiment, adjacent frame-like portions 21 are interconnected by flexible connecting portions 26 with each other to integrally form the numerous convex parts, so that the general-purpose spacer can be easily wound spirally and then stored in a manner that the convex parts are hidden inside, in a storage space smaller than those for conventional spacers, and with facilitated transportation.

The other functions and effects of the general-purpose spacer of this embodiment are the same as those in the above-described first embodiment.

Further, the general-purpose spacer according to the embodiment described just above can be used not only for a human body, but also for a pet-aimed sheet, for example, and as a closet aimed spacer against moisture in a manner to be interposed between a floor of a closet and a futon mattress, or between futon mattresses. Although conventional spacers for closet have been used in shapes of grates made of wood, the general-purpose spacer of this embodiment can be wound and stored during disuse, thereby facilitating storage, with facilitated handling by virtue of the decreased weight.

Furthermore, the general-purpose spacer of this embodiment can be used upon arranging food products such as vegetables in supermarkets, as a food product aimed spacer to be used by deploying it under food products. The food product aimed spacer of the present invention can be wound and stored during disuse, thereby facilitating storage, with facilitated handling by virtue of the decreased weight.

Moreover, without limited to the above-described usage as the closet aimed spacer and food product aimed spacer, the general-purpose spacer of this embodiment can be used in any usage where a space is to be ensured. For example, the general-purpose spacer can be used as a heat insulation spacer in a manner to be wound around an outer periphery of piping which is disposed outdoors to allow warm water or cold water to flow therethrough.

Fifth Embodiment

Figure 7:
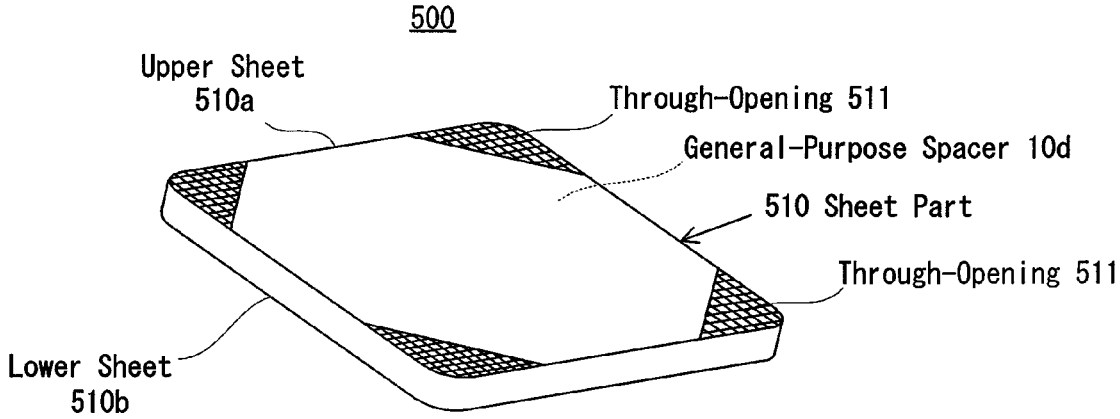
FIG. 7 is a schematic perspective view of a pet-aimed sheet according to a fifth embodiment of the present invention.

There will be explained a fifth embodiment of the present invention. FIG. 7 is a schematic perspective view of a pet-aimed sheet according to the fifth embodiment of the present invention. Note that the general-purpose spacer 10*d* of the above-described fourth embodiment is adopted as a spacer for the pet-aimed sheet of this embodiment.

As shown in FIG. 7, the pet-aimed sheet 500 of this embodiment comprises: a general-purpose spacer 10*d*; a sack-shaped sheet part 510 for housing the general-purpose spacer 10*d* therein; and through-openings 511 formed at four corners of an upper sheet 510*a* of the sack-shaped sheet part 510 respectively, for allowing air to flow therethrough. The through-openings 511 formed at the four corners of the upper sheet 510*a* are provided by stretching mesh-like members across opening regions defined through the upper sheet, respectively. Note that the through-openings are not limited thereto, and may be formed through the whole of lateral upstanding sides of the sack-shaped sheet part, or through part of the lateral upstanding sides.

According to the pet-aimed sheet of this embodiment, the frame-like portions 21 of the convex parts 20*d*, and the flexible connecting portions 26 are brought to abut on a body of a pet in a manner to avoid rugged feeling against the pet, unlike conventional pet-aimed sheets where tip ends of protrusions abut against bodies of pets.

Further, the shape of the general-purpose spacer to be used in this pet-aimed sheet is not limited to that of the fourth embodiment, and may be the same as any one of those of the human-body aimed spacers according to the variant of the first embodiment, the second embodiment, and the third embodiment, insofar as satisfying the requirement of the above-mentioned general-purpose spacer.

Sixth Embodiment

Figure 8:
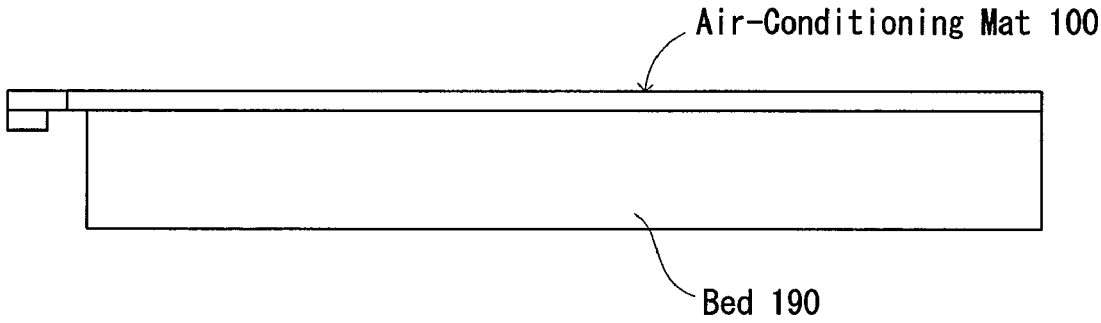
FIG. 8 is a schematic view of an air-conditioning mat according to a sixth embodiment of the present invention, in a state placed on a bed.
Figure 9:
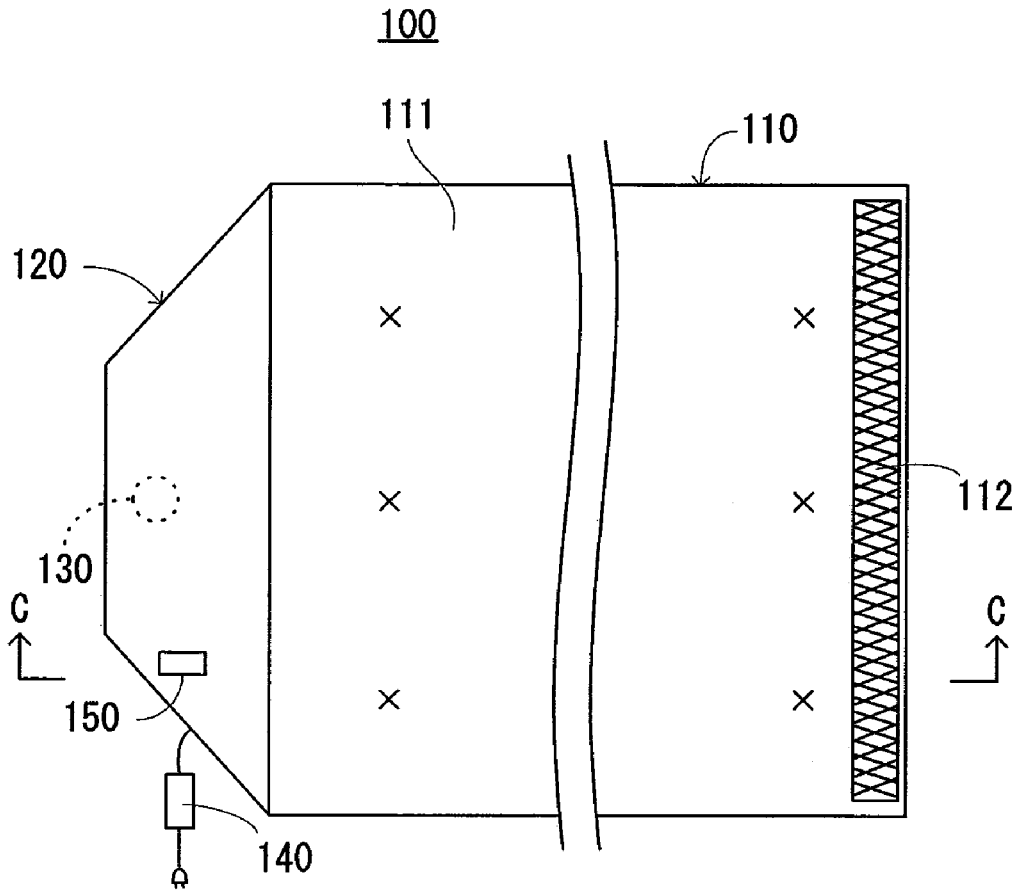
FIG. 9 is a schematic plan view of the air-conditioning mat according to the sixth embodiment of the present invention.
Figure 10:
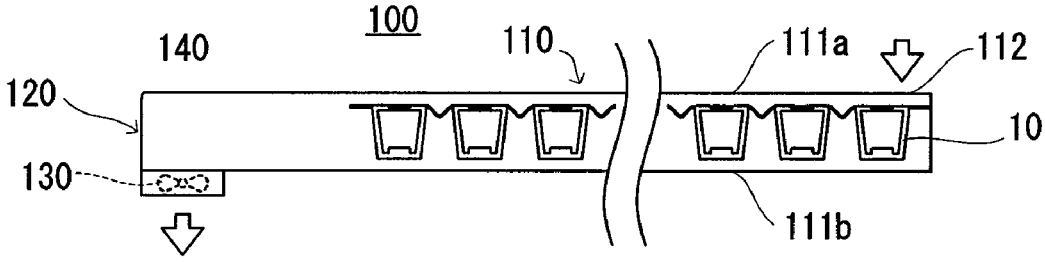
FIG. 10 is a schematic cross-sectional view of the air-conditioning mat of FIG. 9 viewed in a C-C arrow direction.

There will be explained a sixth embodiment of the present invention. FIG. 8 is a schematic view of an air-conditioning mat according to the sixth embodiment of the present invention, in a state placed on a bed, FIG. 9 is a schematic plan view of the air-conditioning mat, and FIG. 10 is a schematic cross-sectional view of the air-conditioning mat of FIG. 9 viewed in a C-C arrow direction. The air-conditioning mat 100 of this embodiment is used by placing it on a bed 190 as shown in FIG. 9. As shown in FIG. 9 and FIG. 10, the air-conditioning mat 100 includes: an airflow passage (human-body aimed airflow passage) 110; a connecting passage 120; a fan 130; a power supply transformer 140 for step-down in a manner to lower a voltage (100V) of a commercial power supply down to a voltage (12V or 24V, for example) which is safe for a human body; and a switch 150 for turning on and off the fan 130. The airflow passage 110 is a passage for air, and comprises a human-body aimed spacer 10 in a rectangular shape of a lateral dimension of about 90 cm and a longitudinal dimension of about 200 cm, and a sack-shaped sheet part 111. Namely, this embodiment adopts the human-body aimed spacer 10 of the first embodiment. Thus, those elements in the human-body aimed spacer 10 of this embodiment which have the same functions as those in the human-body aimed spacer of the first embodiment, are designated by the same reference signs or corresponding reference signs, and detailed explanation thereof will be omitted. Note that although this embodiment is explained for a situation where the human-body aimed spacer 10 of the first embodiment is adopted, the present invention is not limited thereto, and the human-body aimed spacer to be used in this embodiment may be the human-body aimed spacer according to the variant, or the spacer according to the second embodiment, third embodiment, or fourth embodiment.

Further, the human-body aimed spacer to be used in the air-conditioning mat of this embodiment is required to have such a strength (pressure resistance) that the convex parts are not broken even by application of a load of 1,000 kg per 1 $m^2$ to the spacer.

As an upper sheet 111*a* of the sack-shaped sheet part 111, it is possible to adopt any material having a moisture permeability, i.e., a material capable of easily allowing permeation of water vapor while being insusceptible to air leakage, such as a typical cotton cloth. Further, it is also possible to adopt, as a lower sheet 111*b* of the sack-shaped sheet part 111, a cloth insusceptible to air leakage such as one obtained by weaving polyester fibers at a higher density.

The connecting passage 120 acts as a space for smoothly connecting a suction inlet of the fan 130 and an air outlet of the airflow passage 110 with each other, which inlet and outlet have areas different from each other. The connecting passage 120 may be formed of a resin such as plastic. Note that although no spacers are provided in the connecting passage in this embodiment, it is possible to provide a spacer as a core member within the connecting passage 120. The fan 130 of this embodiment is provided to suck outside air through the air inlet part 112, and to flow it into the airflow passage 110 and connecting passage 120.

Upon usage of the air-conditioning mat of this embodiment, as shown in FIG. 8, this air-conditioning mat is placed on a bed such that the connecting passage 120 is positioned outside a foot side of the bed. Further, the air-conditioning mat is placed in a manner that the upper sheet 111*a* abuts on a human body. In this state, the plug of the fan 130 is inserted into an AC outlet and then the switch 150 is turned on, so that the fan 130 is rotated to suck outside air through the air inlet part 112 to thereby discharge the air within the sack-shaped sheet part 111 to the exterior. Outside air sucked through the air inlet part 112 formed in the air-conditioning mat 100 near a head thereof, is flowed through the airflow passage 110 defined by the human-body aimed spacer 10, and through the connecting passage 120, and then discharged to the exterior through a discharge outlet of the fan 130.

According to the air-conditioning mat of this embodiment, ambient air is flowed just below a user's body when the user has lain down on the air-conditioning mat, thereby enabling to increase a temperature gradient and a humidity gradient near that part of the body of the user lying on the air-conditioning mat which part contacts with the air-conditioning mat. As such, even when a user has lain on the air-conditioning mat for a long time, the air-conditioning mat is never warmed by the body temperature and is prevented from getting sweaty, so that the user is allowed to sleep comfortably.

According to this embodiment as described above, the frame-like portions 21 and rising-portion integrators are brought to abut on a body of a user, so that the user is free of rugged feeling, unlike conventional air-conditioning mats.

Further, according to this embodiment as described above, since numerous convex parts 20 are interconnected by flexible connecting portions 26 with one another, respectively, there can be improved elasticity of the air-conditioning mat of this embodiment as compared with conventional ones adopting spacers each including protrusions connected through a base member. Particularly, it is possible to achieve a further improvement of elasticity, by bending the flexible connecting portions 26.

Moreover, according to this embodiment as described above, since adjacent convex parts 20 are interconnected by the associated flexible connecting portion 26 with each other such that numerous convex parts are formed integrally with one another, the air-conditioning mat can be easily wound spirally and then stored in a manner that the convex parts are hidden inside, in a storage space smaller than those for conventional air-conditioning mats, and with facilitated transportation.

Furthermore, according to this embodiment as described above, since adjacent convex parts 20 are interconnected by the associated flexible connecting portion 26 with each other such that numerous convex parts are formed integrally with one another, it becomes possible to decrease an amount of material to be used and thus to lighten the air-conditioning mat of this embodiment in weight as a whole, as compared with conventional air-conditioning mats adopting spacers each including a flat plate-like base member formed with protrusions.

Note that the present invention is not limited to the air-conditioning mat of the sixth embodiment, and the air-conditioning mat adopting the airflow passage of the present invention may be used not only for cooling a human body, but also for warming a human body by flowing warm air through the airflow passage. Further, it is enough for the air-conditioning mat adopting the airflow passage of the present invention, to be used in a manner to simply ensure the airflow passage under a human body, without providing any fan or the like for flowing ambient air, warm air, or the like through the airflow passage. It is possible in this case to promote evaporation of perspiration from the human body through the airflow passage, and to discharge water vapor resulted from evaporation of perspiration to the exterior through the airflow passage.

Other Embodiments

The present invention is not limited to the above embodiments, and various modifications are possible within the scope of the gist of the present invention. For example, although the first through fourth embodiments have been described for situations where the frame-like portions are mainly rectangular, the frame-like portions may be triangular, pentagonal, hexagonal, circular, elliptical, or the like, in shape.

Further, although the above embodiments have been described for situations where the flexible connecting portions are formed in bent shapes, respectively, the flexible connecting portions may be formed in flat shapes without bending.

Furthermore, the above embodiments have each been explained for a situation where the frame-like portions and flexible connecting portions at the human body contact side are so formed that a ratio of area of opening regions is 50 to 95% of a whole area of the spacer face at the side where the frame-like portions are formed. However, it is also desirable that, when the rising-portion integrators are brought to be a side for contacting with a human body, the rising-portion integrators are so formed that a ratio of area of opening regions where rising-portion integrators are not formed is 50 to 95% of a whole area of the spacer face at the side where the rising-portion integrators are formed.

Further, although the rising portion has been constituted of column portions in the first and fourth embodiments and the rising portion has been constituted of wall portions in the second embodiment, such rising portion may be formed of column portions and wall portions. The rising portion may be formed of: four column portions; and one wall portion interconnecting two adjacent column portions of the four column portions, with each other; for example.

Figure 11A:
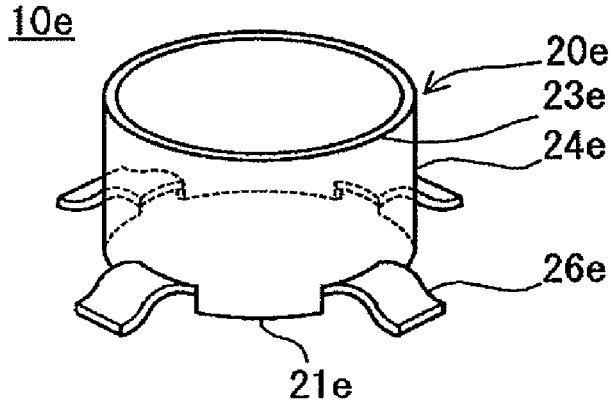
FIG. 11 is a figure showing an exemplary spacer according to a further embodiment, FIG. 11(*a*) is a schematic perspective view of one convex part and associated flexible connecting portions continuing to the convex part, FIG. 11(*b*) is a schematic perspective view of a frame-like portion of the convex part, and FIG. 11(*c*) is a schematic perspective view of a rising-portion integrator of the convex part.
Figure 11B:
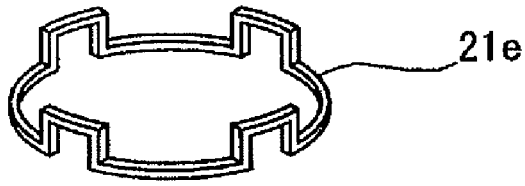
Figure 11C:
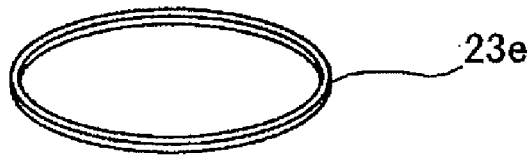

Moreover, the human-body aimed spacer and general-purpose spacer of the present invention are not limited to the above-described shapes, and may be provided in the following shapes. FIG. 11 is a figure showing an exemplary spacer according to a further embodiment of the present invention, FIG. 11(*a*) is a schematic perspective view of one convex part and associated flexible connecting portions continuing to the convex part, FIG. 11(*b*) is a schematic perspective view of a frame-like portion of the convex part, and FIG. 11(*c*) is a schematic perspective view of a rising-portion integrator of the convex part. Note that the shape of the spacer shown in FIG. 11 can be applied to both of the human-body aimed spacer and general-purpose spacer.

The spacer 10*e* shown in FIG. 11 includes a convex part 20*e* having features that the same is formed of a cylinder having four cut-outs and flexible connecting portions 26*e* each continue to an upper end of the associated cut-out. Thus, the frame-like portion 21*e* in this case exhibits a shape as shown in FIG. 11(*b*). In this way, the frame-like portions of the present invention are not limited to those formed in planar shapes, and may be formed in three-dimensional shapes.

Further, the convex part 20*e* of the spacer 10*e* shown in FIG. 11 has a rising portion constituted of one wall portion in a cylindrical shape as shown in FIG. 11(*a*), and in this case, the upper end portion itself of the wall portion can be regarded as being a rising-portion integrator as shown in FIG. 11(*c*).

Incidentally, the rising-portion integrators of the previously described spacers of the present invention may be each in a shape of plane, bulged hemisphere, or centrally opened donut, as a whole of the rising-portion integrator. Further, when the rising portion is formed of four column portions, the rising-portion integrator therefor may be in a shape of frame successively interconnecting the column portions with one another, or in a shape of "X" for interconnecting diagonally paired column portions with each other in a crossed manner.

Further, although the above embodiments have been explained for situations where the frame-like portion, the associated rising portion, and the associated rising-portion integrator are so formed that they can be distinguished from one another, the frame-like portion, the associated rising portion, and the associated rising-portion integrator may be formed integrally with one another so that they are not distinguished from one another, similarly to the spacer shown in FIG. 11.

Moreover, although the human-body aimed spacer of the first embodiment has been noted to desirably have 400 or more convex parts per 1 $m^2$, it is natural that larger numbers of convex parts lead to less degradation of cushioning properties of a cushion or the like placed under the spacer, and 2,000 convex parts per 1 $m^2$ are ideal, for example. Nonetheless, even in numbers less than 400 such as 100 convex parts per 1 $m^2$, it is possible for a human-body aimed spacer to ensure a space between a human body and a bed or the like, by additionally attaching mesh-like sheet members such as Tricalnet (Trademark) H-02 produced by TAKIRON Co., Ltd., onto both surfaces of the spacer, respectively, for example. Only, numbers of 100 or less of convex parts may deteriorate cushioning properties of a cushion or the like placed under the spacer, and the spacer is increased in cost by an amount of mesh-like sheet members to be attached onto both surfaces of the spacer, which may be impractical.

In turn, although the sixth embodiment has been explained for a situation where the fan is rotated to discharge the air within the airflow passage to the exterior, it is possible for the fan to be rotated to feed outside air into the airflow passage.

Further, although the above embodiments have been explained for situations where frame-like portions of spacer are arranged at a side of the spacer abutting on a human body, the present invention is not limited thereto, and a side of rising-portion integrators of the spacer may abut on a human body. Meanwhile, when rising-portion integrators are small in size, there may be caused such a situation to suck an associated sheet into gaps among convex parts of a spacer upon application of negative pressure to the interior of the airflow passage, thereby failing to ensure a required amount of airstream. In such a case, it is desirable to arrange a mesh-like sheet member between the spacer and the sheet, thereby preventing the sheet from being sucked into the interior of the spacer. As the mesh-like sheet member, it is possible to use one having a mesh size fully smaller than a gap between convex parts of the spacer, such as a Tricalnet (Trademark) N-3 produced by TAKIRON Co., Ltd.

Although the above embodiment has been described for a situation where the bed and the air-conditioning mat are constituted separately, the air-conditioning mat and the bed can be formed integrally. Further, the human-body aimed spacer and human-body aimed airflow passage of the present invention can be applied not only to a bed, but also to a chair, sofa, car seat, carpet, and the like.

Further, although the above embodiments have been described for situations where the spacers are formed by injection molding, the present invention is not limited thereto, and the spacers may be formed by any methods other than injection molding.

INDUSTRIAL APPLICABILITY

As explained above, the human-body aimed spacer of the present invention is configured to cause the rising-portion integrators or the frame-like portions and flexible connecting portions to abut on a body of a user, so that the human-body aimed spacer will never give rugged feeling to the user, unlike conventional cooling spacers. Further, the adjacent convex parts are interconnected by the associated flexible connecting portion to thereby form the numerous convex parts, so that the spacer of the present invention allow for improved elasticity as compared with conventional cooling spacers each configured to interconnect protrusions by a base member. Furthermore, according to the human-body aimed spacer of the present invention, the adjacent convex parts are interconnected by the associated flexible connecting portion with each other to thereby form the numerous convex parts integrally with one another, so that the human-body aimed spacer can be easily wound spirally and then stored in a storage space smaller than those for conventional cooling spacers. Moreover, since the adjacent convex parts are interconnected by the associated flexible connecting portion with each other, it becomes possible to decrease an amount of material to be used and thus to lighten the spacer of the present invention in weight, as compared with conventional cooling spacers each including a flat plate-like base member. Thus, the present invention can be applied to an air-conditioning mat and the like to be deployed on a bed, chair, car seat, and the like.

The invention claimed is:

1. A human-body aimed spacer for ensuring a space near a human body for allowing air to flow therethrough, comprising:

convex parts each comprising: a frame-shaped portion; a rising portion comprising column portions, or wall portions, or column portions and wall portions, each of them having one end formed to rise from the associated frame-shaped portion; and a rising-portion integrator for interconnecting the other ends of the associated rising portion with one another; and flexible connecting portions having flexibility and interconnecting spaced apart adjacent ones of said convex parts with each other;

wherein said convex parts are formed in a number of at least 100 per 1 $m^2$; and wherein said convex parts and said flexible connecting portions are formed of plastic integrally with one another.

2. The human-body aimed spacer of claim 1, wherein said convex parts are each connected to four of said flexible connecting portions.

3. The human-body aimed spacer of claim 1, wherein said flexible connecting portions are each formed of a strip-shaped member bendable to protrude to a side where said rising-portion integrators are formed.

4. The human-body aimed spacer of claim 1, wherein the human-body aimed spacer has a density of 30% or less relative to a volume of the space defined by the human-body aimed spacer.

5. The human-body aimed spacer of claim 1, wherein said frame-shaped portions and said flexible connecting portions are so formed that a ratio of area of opening regions, where said frame-shaped portions and said flexible connecting portions are not formed, is 50 to 95% of a whole area of the spacer face at the side where said frame-shaped portions are formed.

6. The human-body aimed spacer of claim 1, wherein the human-body aimed spacer has a weight within 1 kg per 1 $m^2$.

7. The human-body aimed spacer of claim 1, wherein said convex parts each have a height of 3 mm to 50 mm.

8. The human-body aimed spacer of claim 1, wherein the human-body aimed spacer has a pressure resistance of at least 1,000 kg per 1 $m^2$, in terms of said convex parts.

9. The human-body aimed spacer of claim 1, wherein said flexible connecting portions each extend to the associated frame-shaped portions.

10. The human-body aimed spacer of claim 9, wherein said frame-shaped portions are each formed in a substantially rectangular shape, and wherein said rising portions each comprise two wall portions rising from two opposite sides of an associated frame-shaped portion, respectively.

11. A human-body aimed airflow passage comprising:

the human-body aimed spacer of claim 1, and a sack-shaped sheet part insusceptible to air leakage and configured to cover said human-body aimed spacer, said sack-shaped sheet part comprising a sheet at a side contacting with a human body, and said sack-shaped sheet part having a moisture permeability at least through said sheet;

wherein said sack-shaped sheet part is formed with: an air inlet part for allowing air inflow therethrough; and an air outlet part for discharging air therethrough.

12. A general-purpose spacer comprising:

a plurality of convex parts each comprising: a frame-shaped portion; a rising portion comprising column portions, or wall portions, or column portions and wall portions, each of them having one end formed to rise from the associated frame-shaped portion; and a rising-portion integrator for interconnecting the other ends of the associated rising portion with one another; and flexible connecting portions for interconnecting adjacent ones of said frame-shaped portions with each other in a longitudinal direction and a lateral direction of the general-purpose spacer, said flexible connecting portions each having flexibility capable of being bent by about 180 degrees while keeping the associated convex parts outside;

wherein, assuming that a pitch between centers of adjacent two of said convex parts is P millimeters, the general-purpose spacer is so formed that: P is 5 to 200; the general-purpose spacer has a density p of (10/P+0.2) % to (120/P+10) %, relative to a volume of space defined by the general-purpose spacer; and the height "h" of the general-purpose spacer is (3 to P) millimeters; and wherein said convex parts and said flexible connecting portions are formed of plastic integrally with one another.

13. The general-purpose spacer of claim 12, wherein the plastic is polyethylene or polypropylene.

14. The general-purpose spacer of claim 12, wherein said flexible connecting portions each have a length L of P×(10% to 60%) millimeters.

15. The general-purpose spacer of claim 12, wherein said rising portions are each formed in an inclined manner so that the applicable rising portion approaches a central axis of an associated one of said convex parts as the applicable rising portion approaches from an associated one of said frame-shaped portions toward an associated one of said rising-portion integrators.

16. The general-purpose spacer of claim 12, wherein said frame-shaped portions are each formed in a substantially rectangular shape, and wherein said rising portions each comprise two wall portions rising from two opposite sides of an associated frame-shaped portion, respectively.

17. The general-purpose spacer of claim 12, wherein said frame-shaped portions are each formed in a substantially rectangular shape, and wherein said rising portions each comprise four column portions rising from an associated frame-shaped portion.

* * * * *